United States Patent [19]

Van Haag et al.

[11] Patent Number: 4,903,517

[45] Date of Patent: Feb. 27, 1990

[54] METHOD OF AND APPARATUS FOR REGULATING THE OPERATION OF CALENDERS AND LIKE MACHINES

[75] Inventors: Rolf Van Haag, Kerken; Rainer Schmidt, Steinfurt, both of Fed. Rep. of Germany

[73] Assignee: Kleinewefers GmbH, Krefeld, Fed. Rep. of Germany

[21] Appl. No.: 192,594

[22] Filed: May 9, 1988

[30] Foreign Application Priority Data

May 9, 1987 [EP] European Pat. Off. ..... 87106762.5

[51] Int. Cl.[4] ..... B21B 31/32; B21B 13/00

[52] U.S. Cl. ..... 72/245; 29/113.2; 29/116.2; 100/162 B

[58] Field of Search ..... 100/47, 53, 156, 170, 100/176; 29/113.1, 116.2; 72/245

[56] References Cited

U.S. PATENT DOCUMENTS

| | | | |
|---|---|---|---|
| 4,394,793 | 7/1983 | Pav et al. | 29/116.2 |
| 4,425,489 | 1/1984 | Pav et al. | 29/116.2 |
| 4,457,057 | 7/1984 | Pav | 29/116.2 |
| 4,729,153 | 3/1988 | Pav et al. | 29/116.2 |
| 4,791,863 | 12/1988 | Vahatalo | 100/162 B |

FOREIGN PATENT DOCUMENTS

| | | |
|---|---|---|
| 2825706 | 11/1979 | Fed. Rep. of Germany . |
| 3117516 | 7/1984 | Fed. Rep. of Germany . |

*Primary Examiner*—W. Donald Bray
*Attorney, Agent, or Firm*—Peter K. Kontler

[57] ABSTRACT

The operation of a calender or a like machine with at least one pair of rolls which define an elongated nip and wherein at least one of the rolls is a so-called bending compensation roll is regulated by a computer which transmits signals to adjustable pressure regulating valves in conduits serving to admit pressurized fluid to a plurality of actuators (such as hydrostatic bearing elements and hydraulic cylinder and piston units for the bending compensation roll) which can alter the load parameter (such as the line load or the compressive strain) in discrete zones of the nip. The computer has inputs for signals which indicate the temperature in the nip, for signals which indicate the characteristics of the web that is advanced through the nip, and for signals from a memory for a pressure reaction matrix. The pressure of fluid is regulated in such a way that changes of the actual value of load parameter in a selected zone of the nip do not entail any changes, or do not entail any appreciable changes, in other zones of the nip.

25 Claims, 5 Drawing Sheets

METHOD OF AND APPARATUS FOR REGULATING THE OPERATION OF CALENDERS AND LIKE MACHINES

BACKGROUND OF THE INVENTION

The invention relates to a method of and to an apparatus for operating machines of the type wherein two or more rolls define one or more nips for running sheets or webs of paper, textile material, metallic or plastic foil or the like. Typical examples of such machines are calenders (including supercalenders) and so-called glazing machines. More particularly, the invention relates to improvements in methods of and in apparatus for operating machines wherein at least one nip is defined, at least in part, by a roll with bending compensation, namely a roll having a more or less rigid carrier surrounded by a cylindrical shell which is deformable to a desired extent adjacent different portions of the nip, and wherein different portions of the shell along the nip are deformable and/or otherwise adjustable relative to the carrier and relative to the adjacent roll or rolls by a plurality of discrete actuators in the form of hydrostatic bearing elements, fluid-operated cylinder and piston units which can move the ends of the carrier and/or other types of moving and/or deforming means.

In certain machines of the above outlined character, the pressure of fluid medium which is admitted into the actuators is a function of the desired or reference value profile of a load parameter in the nip. When the reference value for the actuator controlling a selected zone of the nip is changed, this entails pressure changes in actuators for the other zones of the nip. As a rule, the actuators receive pressurized fluid (such as oil) by way of conduits which contain adjustable pressure regulating valves, i.e., the pressure of fluid which is admitted to a particular actuator is changed by adjusting the setting of the respective pressure regulating valve.

In most instances, the load parameter which is of importance in machines to which the present invention pertains is the line load (namely the magnitude of the force per unit length of the nip) or the compressive strain (this is the magnitude of the force per unit area) along the nip. It is important and highly desirable to ensure that the load parameter (be it the line load, compressive strain or a variable which is a function of line load and/or compressive strain) along the nip of two rolls in a calender or a glazing or analogous machine will assume a value which matches the desired (reference) value as well as that the reference value will be matched or closely approximated when the machine is in actual use. This cannot be accomplished in presently known machines because it is not possible to measure the forces which develop in the nip of two rolls when a calender or an analogous machine is in actual use.

German Offenlegungsschrift No. 28 25 706 of Biondetti proposes to employ a simplified mechanical model of the machine and to measure the distribution of forces in the nip of two rolls in the model. To this end, the rolls which are to define the nip are replaced by beams, and pressure monitoring gauges are installed in longitudinally spaced-apart zones of the nip. Each pressure monitoring gauge is operatively connected with a pressure generating element at that side of one of the beams which faces away from the nip. Each pressure generating element corresponds to a hydrostatic or other bearing element of an operative calender or a like machine. Each zone of the nip of the two beams (imitation rolls) is controlled by a regulator having a first input for the application of a signal denoting an adjustable reference value of the load parameter in question and a second input for the actual value (denoted by a signal which is transmitted by the corresponding pressure monitoring gauge) of the load parameter in the respective zone of the nip. The regulator compares the two signals and transmits to the associated pressure generating element a signal which is indicative of the difference (if any) between the actual and monitored values of the load parameter in the corresponding zone of the nip of the two beams. Such signal from the regulator to the pressure generating element selects the appropriate pressure of fluid in the pressure generating element. The regulator is further connected with the pressure generating elements (actuators) of the machine so that the pressure in the nip of two rolls in the machine is regulated in the same way as the pressure in the nip of beams forming part of the model. If the reference value is changed for any given zone of the nip, the stiffness of the beams causes that such change of reference value in the given zone alters the conditions prevailing in the neighboring zones of the nip; this, in turn, causes the regulator or regulators for the neighboring zone or zones to bring about corresponding changes of conditions prevailing in the respective zone or zones of the nip i.e., to bring about corresponding changes of pressure of fluid in the respective pressure generating element or elements of the model and in the respective actuator or actuators of the machine whose operation is to be controlled as a function of monitoring the conditions in the nip of the beams forming part of the model.

A calender or a like machine is often a very large unit wherein the length of the rolls is in the range of several meters. Therefore, it is very difficult to build a model which is a sufficiently close replica of the original machine. In addition, important parameters of a calender or a like machine are changed, for example, when one or more rolls having elastic coats are treated (e.g., milled) with attendant reduction of their diameters. This alters the weight and the rigidity of the thus treated rolls. Alternatively or in addition thereto, the parameters of a calender or a like machine will change in response to changes of overhanging weights, for example, when it is necessary to change one or more guide rollers for the running web, strip or sheet of material which is to be treated during travel through the nip. Such changes cannot be taken into consideration in models of the type disclosed by Biondetti.

German Pat. No. 31 17 516 to Surat discloses a method according to which external corrections of the pressure regulating signal for a given group of bearing elements in a calender or an analogous machine entail the generation of auxiliary correction signals which are applied to the controls for neighboring groups of bearing elements so as to compensate for changes in those zones of a nip under the control of neighboring groups of bearing elements, namely for changes which are attributable to external corrections of the pressure regulating signal for the given group of bearing elements. This method completely disregards the conditions which prevail in the nip. Though a change in one zone of the nip entails compensatory changes in other zones of the nip, the applied auxiliary correction signals do not ensure that the conditions prevailing in the other zones will remain unchanged, i.e., that they will match or at least approximate the desired conditions.

Controlled deflection rolls with bending compensation are disclosed in numerous United States and foreign patents of the assignee. Reference may be had, for example, to U.S. Pat. Nos. 4,394,793, 4,425,489 and 4,457,057.

OBJECTS AND SUMMARY OF THE INVENTION

An object of the invention is to provide a method which ensures that one can change the load parameter in a selected zone of the nip of two rolls in a calender or a like machine without thereby effecting a change of the load parameter or parameters in the other zone or zones of the nip.

Another object of the invention is to provide a novel and improved method of controlling the pressure which is applied to the actuators of a roll in a calender or a like machine.

A further object of the invention is to provide a method which can be practiced to accomplish the above-enumerated objects without resorting to a mechanical model of the machine.

An additional object of the invention is to provide a novel and improved method of controlling the operation of a calender or a glazing machine with a heretofore unmatched degree of accuracy and predictability.

Still another object of the invention is to provide a novel and improved apparatus for regulating the operation of calenders and like machines.

A further object of the invention is to provide a machine which embodies the improved apparatus.

An additional object of the invention is to provide novel and improved controls for a calender roll of the type wherein a non-rotatable carrier is surrounded by a rotary deformable cylindrical shell.

Another object of the invention is to provide novel and improved computerized controls for calender rolls and the like, and more particularly for those components which influence the conditions prevailing in the nips of calender rolls.

A further object of the invention is to provide novel and improved means for regulating the actuators which directly influence the load parameter in the nip of two rolls in a calender or a like machine.

One feature of the present invention resides in the provision of a method of regulating the operation of a calender or an analogous machine with at least two neighboring rolls which define an elongated nip and the load parameters (such as the line load or the compressive strain) in a plurality of longitudinally spaced-apart zones of the nip are controlled by discrete actuators which receive a fluid medium (e.g., oil) at a variable pressure so that the actuators can alter the load parameters in the corresponding zones of the nip, and wherein a change to bring about a deviation of a load parameter in one of the zones from a reference value tends to entail changes of load parameters in other zones of the nip. The method comprises the steps of establishing at least one pressure reaction matrix with elements which denote those deviations of actual values of load parameters for the other zones from reference values which take place in response to a change of load parameter in the one zone of the nip, utilizing the matrix to individually calculate seriatim for the actuator for each other zone that pressure variation which at least partially compensates for departure of actual value of the load parameter in the respective zone from the reference value and to further calculate the resulting change of load parameter for each other zone until an error function which is dependent upon the differences between actual values of load parameters and the reference values is within a predetermined range of tolerances, and varying the pressure of fluid for the actuators in accordance with the sum of variations which are calculated for the respective actuators.

The pressure reaction matrix can be said to constitute a mathematic tool or medium which describes or represents the machine in a highly accurate way. Changes of operation of the machine, such as may be attributable to a reduction of the diameters of elastic rolls, replacement of worn or damaged rolls with fresh rolls, redesigning and/or different distribution of overhanging weights including guide rollers for the running webs, sheets or strips of material to be treated during travel in the nip of the rolls and/or others, can be accounted for in a simple and efficient manner by replacing the pressure reaction matrix or at least some of its elements with a different matrix or with different elements so that the newly employed matrix is again accurately representative of the modified machine.

The matrix can be utilized to carry out an iterative or repetitive computing operation which takes into consideration the effect of each and every pressure change upon all zones of the nip and according to which errors which are detected in individual zones are mathematically eliminated by bringing about pressure changes until the error function (which is dependent upon the differences between the actual values of parameters and the reference values) is within the aforementioned range of tolerances, i.e., less than a predetermined maximum acceptable error. The sum of all such pressure changes is utilized to derive for each zone a correct control signal which is utilized to vary the pressure for the corresponding actuator. This ensures that the reference value profile of the load parameters matches the desired profile along the entire nip. The establishment of a pressure reaction matrix ensures that such computation can be carried out in a relatively simple way, i.e., it suffices to employ relatively small computer means and one or more relatively small memories for one or more matrices. The computing time is so short that 20–100 iteration steps can be carried out without necessitating an interruption of the operation.

The establishment of a pressure reaction matrix can include the steps of individually ascertaining for each zone of the nip the extent of alteration of load parameter in one of the zones in response to a predetermined variation of fluid pressure for the respective actuator while the fluid pressure for all other actuators remains unchanged, and forming quotients of parameter alterations and pressure variations. Such quotients constitute the elements of the matrix, and the latter has lines which pertain to the zones of the nip and columns pertaining to the actuators.

In this manner, one systematically obtains those data of the original machine which are essential for appropriate selection of pressures for the actuators and which influence the establishment of a truly representative pressure reaction matrix. The lines of the matrix can extend horizontally or vertically, and the columns of the matrix can extend vertically or horizontally.

The elements of the matrix can be ascertained in a number of different ways. For example, pressure-responsive materials can be introduced into the zones of the nip, and the extent of response or reaction of the introduced pressure-responsive material to pressure is monitored for the purpose of generating signals which denote the results of measurements and constitute the elements of the matrix. A suitable pressure-responsive material is, among others, NCR-paper which can be evaluated by a brightness measuring instrument. Brightness measuring instruments which can be used for evaluation of NCR-paper are distributed by the firm Elrepho.

A presently preferred mode of ascertaining the elements of the pressure reaction matrix is to form a mathematical model of the machine and to utilize the model for computation of the elements. The model can exhibit all important characteristics of the machine, such as the rigidity of the roll or rolls and/or carrier of deformable shell and shell in a roll with bending compensation, moduli of elasticity of hardened or coated rolls, overhanging weights, and others.

The computation on the basis of a mathematical model can be carried out with particular advantage by resorting to the finite element procedure which is frequently resorted to in actual practice. Another suitable computing step is the so-called method of transfer function matrices.

The step of establishing the matrix can include setting up a load parameter whose reference value is constant in all zones of the nip, and changing such load parameter from zone to zone for the purpose of ascertaining the elements of the matrix. This ensures that the circumstances for computation of all elements of the matrix are the same.

When the machine is in use, the actual values of load parameters can be caused to conform to the reference values by carrying out the steps of (a) ascertaining the zone with a maximum difference between the actual value ad the reference value of the load parameter and utilizing the respective element of the matrix for calculation of a pressure variation which corresponds to the maximum difference, (b) utilizing the thus calculated pressure variation and the elements in the corresponding line of the matrix for the calculation of load parameter alterations in other zones of the nip, (c) forming for the load parameter of each zone a new actual value by totalizing the previous actual value and the respective alteration, (d) calculating for a zone other than the ascertained zone (namely other than the zone with maximum difference between the actual value and the reference value of the load parameter)—and with the corresponding element of the matrix—a pressure variation which effects an alteration of the load parameter corresponding to the difference between the new actual value and the reference value, (e) utilizing the pressure variation and the elements in the same line of the matrix for calculation of load parameter alterations in other zones of the nip, (f) forming for each zone a new actual value of the respective load parameter from the sum of the previous actual value and the alteration of the respective parameter, (g) repeating the steps (d) and (e) and (f) for other zones of the nip until the error function is within the aforementioned range, and (h) varying the fluid pressure for the actuators so that the fluid pressure equals the sum of the theretofore prevailing pressure and all corresponding pressure variations.

It is further within the purview of the invention to resort to an establishing step which comprises setting up a plurality of two-dimensional matrices for different operating conditions of the machine. The utilizing step then comprises employing that one of the plurality of matrices which is compatible with the momentary operating conditions of the machine. Such method takes into consideration that the conditions in the machine do not change linearly, i.e., an optimum accuracy is achieved only if one employs different matrices for different operating conditions. The matrices can be selected automatically (in response to changes in operating conditions) or by the operator of the machine.

For example, it is possible to set up at least two matrices for at least two different ranges of reference values of the load parameter, for at least two different diameters of at least one of the rolls, and for at least two different average temperatures of the peripheral surface of at least one of the rolls. It is also possible to set up different matrices for different weights of the rolls (this is important when a used roll is replaced with a fresh roll), for different overhanging weights, for different hardnesses of the rolls, for different ballast values and/or for different characteristics of the web which is treated in the machine.

The method can further comprise the steps of ascertaining for each zone of the nip the extent of load parameter alteration in response to a plurality of predetermined temperature changes in the respective zone, and utilizing the thus ascertained load parameter alterations as correction factors for the differences between the actual values and the reference values of the respective load parameters. These steps account for the influence of temperature changes and the resulting changes of diameter(s) of the roll(s). If the temperature rises in one of the zones, it is normally possible to reduce the pressure of fluid which is supplied to the corresponding actuator. The temperature can be measured along the nip, and the corresponding pressure reaction matrix and/or the temperature-dependent correction elements or elements can be selected automatically in accordance with the results of the temperature measurement. The measured temperatures can be used for calculation of an average temperature along the nip so that the matrix can be selected in accordance with the ascertained average temperature.

If the machine comprises at least three rolls two of which are bending compensation rolls and which define at least two nips, the step of establishing at least one pressure reaction matrix can include setting up a matrix with elements for all zones of each nip. This accounts for the fact that a change of pressure of fluid which is supplied to an actuator for a zone of one of the nips influences the load parameters in other zones of the one nip as well as the load parameters in the zones of the other nip or nips.

One or more actuators for the zones of a nip can include hydraulic cylinder and piston units which can act upon the end portions of the carrier for the shell of a roll with bending compensation. Such units can influence the load parameters in the two outermost zones of a nip. This renders it possible to use the matrix for adjustments of the pressure of fluid which is supplied to such cylinder and piston units so as to ensure that the load parameters in the outermost zones can be maintained or altered in the same way and for the same purposes as the load parameters in the intermediate zones of the nip.

The computation can be completed with little loss in time if the varying step includes varying the pressure of fluid for the actuator which controls the zone with a maximum difference between the actual value and the reference value of the respective load parameter. This renders it possible to reduce the number of iteration steps to a minimum.

It is desirable to repeat the utilizing step a number of times which at least matches the number of zones in the nip. As a rule, or in many instances, the number of iterative steps will be at least twice the number of zones in a nip before the error function will be within the predetermined range of tolerances.

It is further often desirable to ensure that the utilizing step be started with and repeated at least once for a particular actuator. It has been found that pressure changes which are carried out in the other zones in order to eliminate the departures or errors therein exert an influence upon the load parameter in the zone which is controlled by the particular actuator, and such influence can be eliminated or compensated for by repeating the utilizing step for the particular actuator.

It was also discovered that a highly satisfactory value for the error function is the square root of the sum of squares of errors for all of the zones. Such error function ensures that the deviations of freshly calculated actual values of the load parameters for all zones of the nip match or closely approximate the respective reference values.

The load parameter profile along the nip can also be varied as a function of changes of the characteristics of a web which is caused to advance through the nip. This can be achieved by monitoring the characteristics of the advancing web and utilizing the results of the monitoring operation to vary the load parameter profile along the nip.

Another feature of the invention resides in the provision of an apparatus for regulating the operation of a calender or an analogous machine wherein at least two neighboring rolls define an elongated nip and at least one of the rolls is deformable by a plurality of discrete actuators, one for each of a plurality of different portions or zones of the nip, and wherein the actuators are connected with a source of pressurized fluid and the pressure of fluid is variable by signal-responsive regulating devices (such as pressure regulating valves or flow restrictors) to thereby alter the load parameters, such as the line load or the compressive strain in the respective zones or portions of the nip. The apparatus comprises computer means having first input means for signals denoting reference values of the load parameters and second input means, and a memory which is arranged to store at least one pressure reaction matrix and is connected with the second input means. The matrix has elements which are indicative of those deviations of actual values of load parameters for the zones of the nip from reference values which take place in response to a change of fluid pressure for one of the actuators. The computer means has signal transmitting output means connected with the regulating devices. The computer means is programmed to conform the actual values of load parameters to the desired reference values. All that is necessary is to furnish the computer means with necessary data so that the computer means can transmit appropriate signals to the regulating devices upon appropriate evaluation and processing of the data.

It is preferred to interpose regulating means between the regulating devices and the computer means. Such regulating means is preferably provided with means for transmitting the signals from the computer means to the regulating devices in the form of ramp functions so as to prevent abrupt changes of fluid pressure for the actuators. The arrangement is preferably such that the regulating means converts into ramp functions at least those signals from the computer means which would or could cause abrupt and pronounced changes of fluid pressure for the respective actuators. This reduces the likelihood of undesirable vibrations and/or other stray movements.

It is further advisable to provide means for monitoring the temperature along the nip and for transmitting corresponding signals to the computer means so that the signals from the temperature monitoring means can influence the signals from the computer means to the pressure regulating devices. The temperature monitoring means can include a plurality of discrete temperature monitoring units (e.g., one for each zone of the nip), or it can comprise a single monitoring unit which is movable along the nip in a manner well known from the art of calenders and like machines.

The apparatus can further comprise means for monitoring the characteristics of the web which advances through the nip and for transmitting to the computer means signals which are indicative of monitored characteristics so that the signals from the computer means to the pressure regulating means are influenced by signals from the monitoring means. Such monitoring means can be designed to monitor the characteristics of a plurality of spaced-apart portions of the running web, e.g., to monitor the characteristics of the web upstream and/or downstream of each zone of the nip. Signals from the monitoring means can be transmitted to a converter which is connected with the first input means of the computer means so as to transmit reference values for the load parameters. Thus, the computer means can receive signals denoting the reference values of the load parameters from an overriding circuit.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
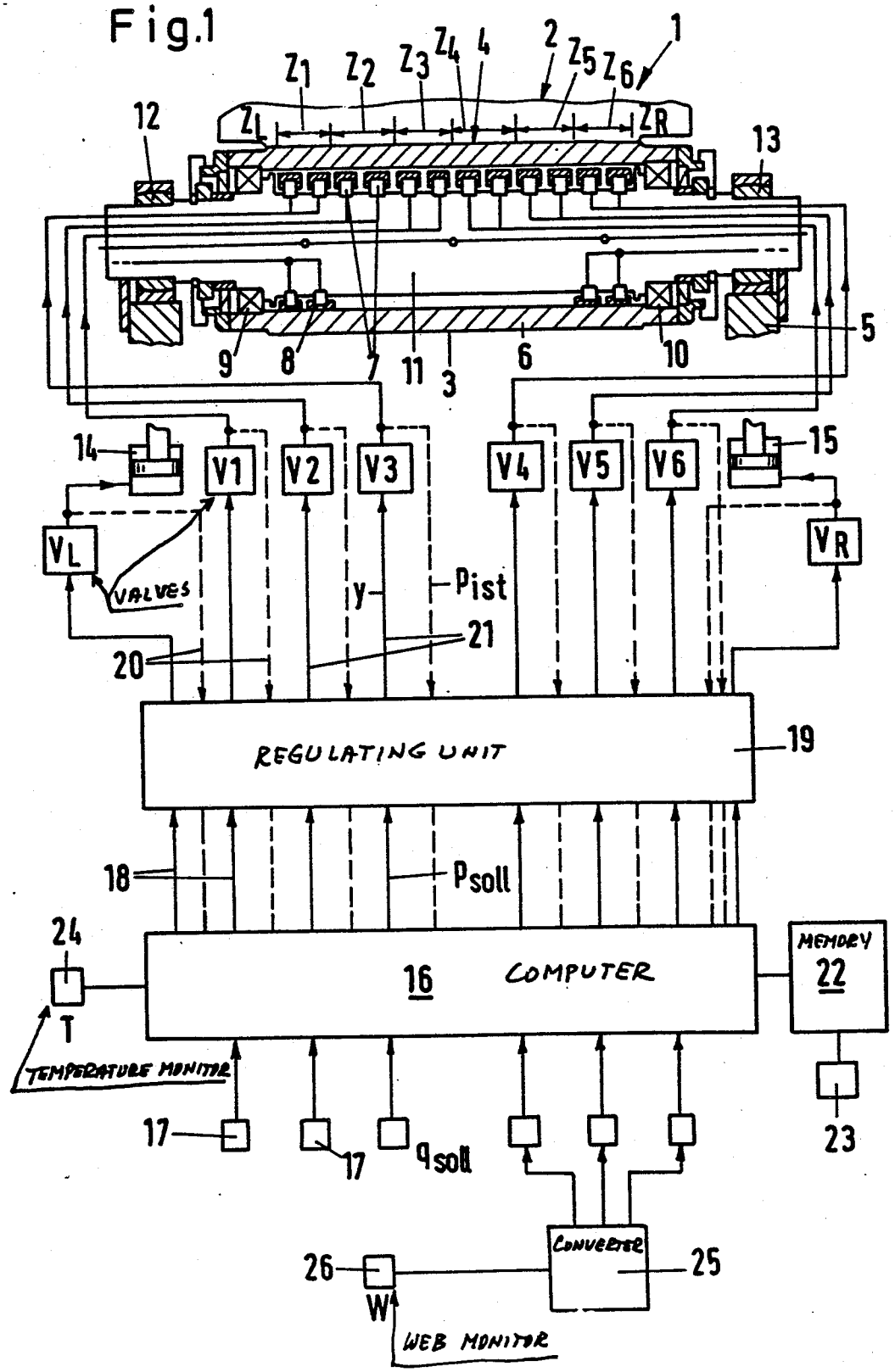
FIG. 1 is a fragmentary schematic partly sectional view of a calender with two rolls and a block diagram of an apparatus which serves to regulate the operation of the calender in accordance with an embodiment of the present invention.
Figure 2:
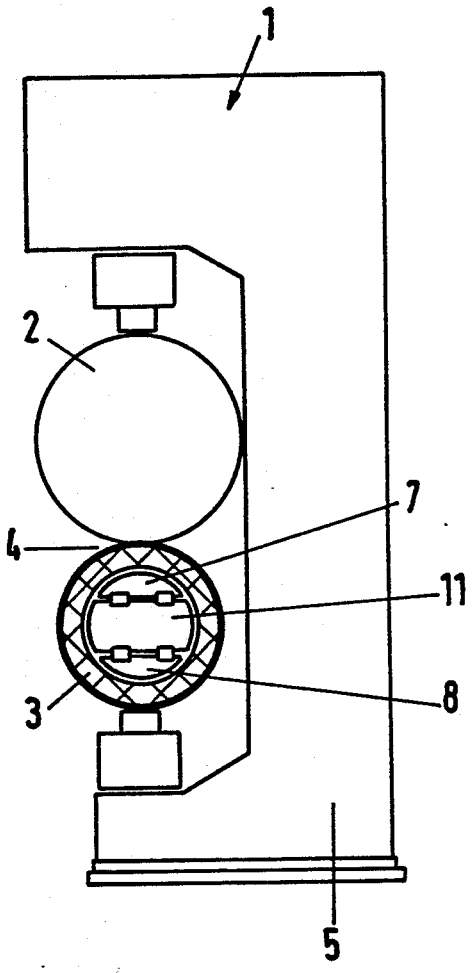
FIG. 2 is a smaller-scale partly side elevational and partly vertical sectional view of the calender of FIG. 1.

FIGS. 1 and 2 show a portion of a machine 1 which can constitute calender or a glazing machine (hereinafter called calender for short) wherein an upper roll 2 cooperates with a lower roll 3 to define an elongated horizontal nip 4. The rolls 2, 3 are rotatably mounted in the frame 5 of the calender 1, and the lower roll 3 comprises a non-rotatable carrier 11 and a hollow cylindrical shell 6 which surrounds the carrier 11. The upper roll 2 is rotatable about a fixed axis and the shell 6 of the lower roll 3 is deformable and/or movable radially relative to its carrier 11 under the action of some or all of twelve upper (primary) hydrostatic bearing elements 7 and/or twelve lower (secondary) hydrostatic bearing elements 8. The primary bearing elements 7 form at least one row, which is parallel to the axis of the roll 3, and are disposed between the carrier 11 and the internal surface of the shell 6 in the region of the nip 4. The secondary bearing elements 8 are disposed diametrically opposite the primary bearing elements 7. The end portions of the carrier 11 are mounted in spherical bearings 12, 13 which are installed in the frame 5 of the calender 1. The end portions of the shell 6 rotate on antifriction bearings 9, 10. The periphery of the roll 2 and/or 3 can be provided with a layer of elastic material. The spherical bearings 12, 13 for the non-rotatable carrier 11 can be moved up and down by discrete fluid-operated (preferably hydraulic) motors in the form of cylinder and piston units 14, 15. The purpose of the units 14, 15 is to cause the carrier 11 to urge the shell 6 upwardly toward the adjacent lowermost portion of the peripheral surface of the upper roll 2.

The lower chambers of the cylinder and piston units 14, 15 can receive a pressurized hydraulic fluid by way of pressure regulating valves $V_L$ and $V_R$, respectively. The primary bearing elements 7 are assembled into six neighboring groups of two bearing elements each, and each such group can receive pressurized hydraulic fluid by way of a discrete pressure regulating valve V1, V2, V3, V4, V5, V6, respectively. Similar pressure regulating valves can be provided for pairs of neighboring secondary bearing elements 8. The eight centrally located secondary bearing elements 8 and the pressure regulating valves for all of the secondary bearing elements are omitted in FIG. 1 for the sake of simplicity and clarity.

In the following passages of the specification, the hydraulic cylinder and piston units 14, 15 as well as the six groups of two primary bearing elements each 7 will be referred to as adjustable actuators A (they are adjustable in that each thereof can be acted upon by hydraulic fluid at any one of a number of different pressures). Each of the actuators A controls the corresponding portion or zone of the nip 4. Thus, the actuator A including the unit 14 controls the marginal zone $Z_L$, the actuator A including the unit 15 controls the marginal zone $Z_R$, and the six actuators A which comprise pairs of hydrostatic bearing elements 7 control the six intermediate zones $Z_1$, $Z_2$, $Z_3$, $Z_4$, $Z_5$ and $Z_6$. The secondary bearing elements 8 serve primarily or exclusively to tension the shell 6, namely to pull the topmost portion of the internal surface of the shell 6 toward the adjacent vertically movable portions of the primary bearing elements 7. Therefore, it normally suffices to supply the chambers of the secondary bearing elements 8 with a hydraulic fluid which is maintained at a constant pressure. The pairs of neighboring secondary bearing elements 8 can be said to constitute actuators A only if they are also supplied with hydraulic fluid at a variable pressure; each such actuator then influences the corresponding intermediate zone ($Z_1$ to $Z_6$) of the nip 4 between the two marginal zones $Z_L$ and $Z_R$.

The means for selecting the pressure of fluid which is to be supplied to the eight actuators A of the calender 1 of FIGS. 1 and 2 includes a programmable computer 16 which has inputs 17 for reference values $Q_{soll}$ denoting a parameter of the load which is to prevail in the nip 4 of the rolls 2 and 3, particularly the line load (the magnitude of the force per unit length) or the compressive strain (the magnitude of the force per unit area). The outputs of the computer 16 transmit control signals $p_{soll}$, and such signals denote the desired pressure of fluid flowing from the valves $V_L$, V1–V6 and $V_R$ to the respective actuators A. The character 18 denotes a bus which transmits signals $p_{soll}$ to a regulating unit 19 which has a programmable memory and wherein the transmitted signals $P_{soll}$ are compared with signals $P_{ist}$ denoting the actual pressure of fluid in the respective actuators A. The regulating unit 19 receives signals $p_{ist}$ from pressure monitoring devices provided in the conduits between the valves $V_L$, V1–V6, $V_R$ and the respective actuators A and connected to the unit 19 by conductors 20. The signals $p_{soll}$ which reach the regulating unit 19 are compared with the respective signals $p_{ist}$, and the unit 19 then transmits signals y via conductors 21 on to the respective valves. Signals y which are transmitted via conductors 21 denote the extent to which the respective valves must be adjusted in order to ensure that the pressure of fluid in the associated actuators A will match the corresponding pressure $p_{soll}$.

The regulating unit 19 performs the additional function of ensuring that, if the intensity of a signal $p_{soll}$ (denoting the desired pressure) changes abruptly, the intensity of the corresponding signal y which is transmitted by way of the respective conductor 21 changes only gradually in accordance with the so-called ramp function.

The computer 16 is connected with a memory 22 which stores data denoting the desired values of load parameters in the eight zones of the nip 4 and which further stores several pressure reaction matrices which will be described in detail hereinafter. Such matrices are admitted into the memory 22 via input means 23.

The computer 16 is also connected with a temperature monitoring or sensing device 24 which transmits signals denoting the temperature T of at least one of the rolls 2, 3, particularly the temperature of the roll 2, at several points along the axis of the respective roll or rolls. The manner in which the temperature can be monitored at several points along the axis of a calender roll is disclosed, for example, in German Pat. No. 31 31 799.

The signals $q_{soll}$ can be applied to the corresponding input or inputs 17 of the computer 16 by hand. This is shown in the left-hand portion of FIG. 1. However, it is equally possible to apply the signals $q_{soll}$ through the medium of a converter 25 which receives signals from a monitoring or measuring device 26 of the type disclosed, for example, in German Pat. No. 31 31 799. The device 26 monitors the web W of paper, textile material or metallic or plastic foil which is caused to advance through the nip 4 of the rolls 2, 3 so as to ascertain the thickness of the running web, the brightness or luster, the smoothness and/or other variable parameters the full width of the web. As is known in the art, such parameters can be influenced by changing the line load in the corresponding zone or zones of the nip 4.

Figure 3:
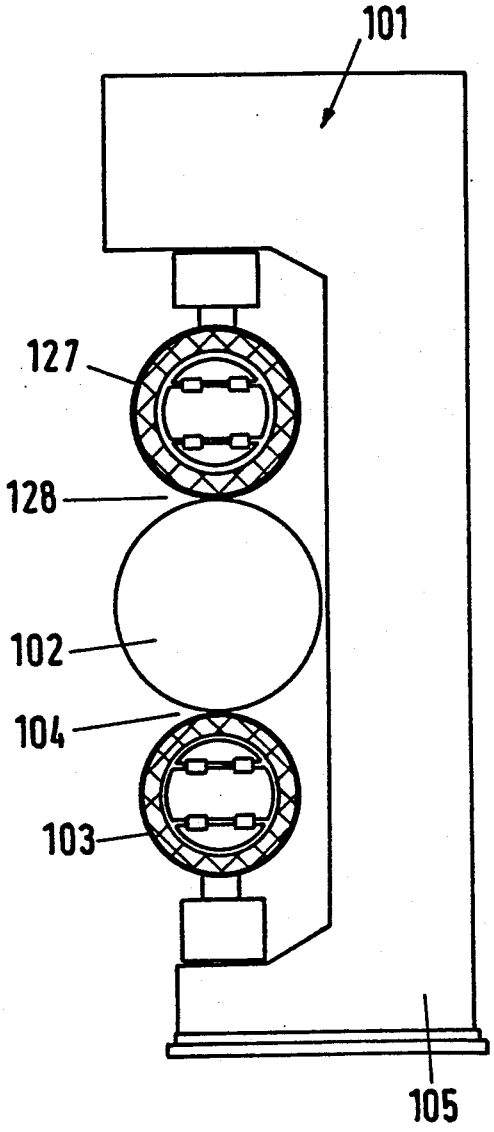
FIG. 3 is a partly side elevational and partly vertical sectional view of a modified calender with three rolls.

The calender 1 of FIGS. 1 and 2 has only two rolls 2, 3 which define a single nip 4. FIG. 3 shows a so-called compact calender 101 wherein the median roll 102 rotates in the frame 105 about a fixed axis. A lower roll 103 can be biased upwardly in the same way as described for the roll 3 of FIGS. 1–2. An upper roll 127 can constitute a mirror image of the roll 103 and is or can be biased downwardly in the same way as defined in connection with the roll 3 of FIGS. 1–2. The nip of the rolls 102, 127 is shown at 128. The action of the rolls 102, 127 upon a web which is caused to run through the nip 128 can be regulated in the same way as already described (in part) and as will be described hereinafter.

Figure 4:
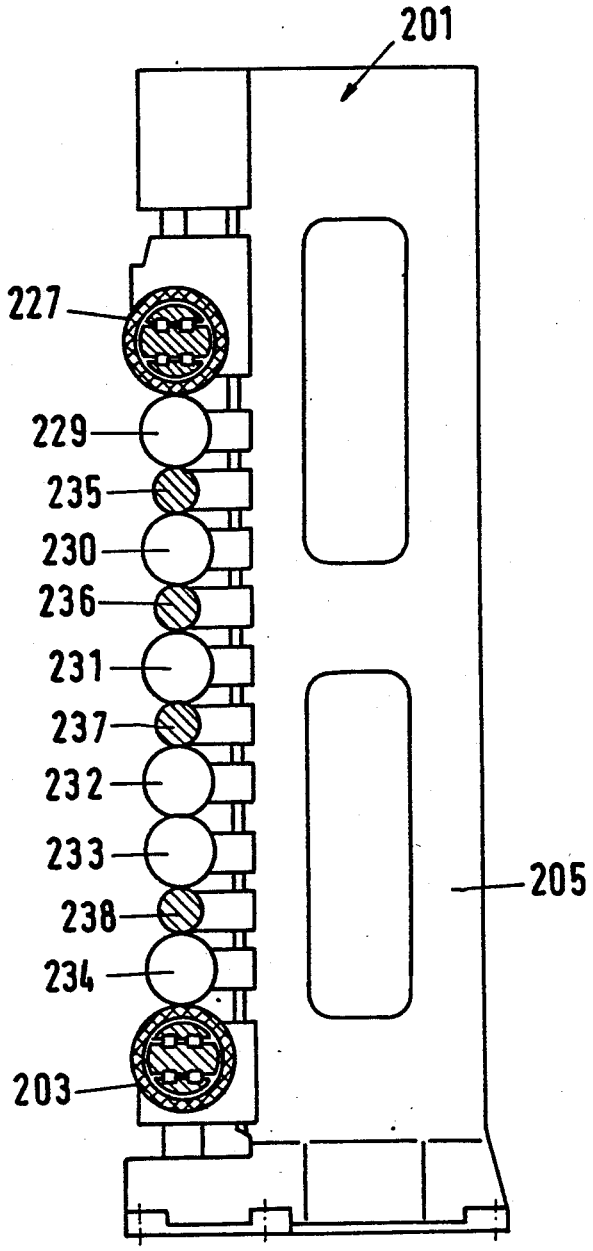
FIG. 4 is a partly side elevational and partly vertical sectional view of a supercalender.

FIG. 4 shows a supercalender 201 wherein the lowermost roll 203 is or can be constructed in the same way as the roll 3 of FIGS. 1–2. The same applies for the uppermost roll 227 which is a mirror image of the roll 203. The supercalender 201 further comprises ten intermediate rolls including six coated rolls 229, 230, 231, 232, 233 and 234, and four hardened rolls 235, 236, 237 and 238. The bearings 12, 13 (not shown in FIG. 4) for the carrier of the lowermost roll 203 are not movable up and down, i.e., these bearings are mounted directly in the frame 205 of the supercalender 201 (at least when the supercalender is in actual use). The uppermost roll 227 is a mirror image of the roll 3 in FIG. 1 except that the antifriction bearings (corresponding to the bearings 9, 10 of FIG. 1) are omitted so that the entire shell of the roll 227 can move up or down radially of the respective carrier.

In each of the heretofore described calenders, it is desirable to ensure that the actual value of the load parameter (such as the line load or the compressive strain) match the desired reference profile as well as to carry out the necessary adjustments in one or more zones of the nip when changes of the reference value are effected as a result of monitoring or measurement of the running web. Since the systems of rolls in a calender of the type to which the present invention pertains, and wherein a correction is carried out in one or more selected zones, react to such correction or corrections not only in the respective zone or zones (i.e., where the correction was actually carried out) but also in certain other zone or zones, it is necessary to trigger an adjustment of pressures in the actuators A in such a way that the desired effects of adjustment are indeed felt in the zones or regions where they are desired or necessary. To this end, the present invention proposes two undertakings, namely (a) the establishment of a pressure reaction matrix for the respective calender, and (b) computation of the corresponding control signals by utilizing the pressure reaction matrix.

Figure 5:
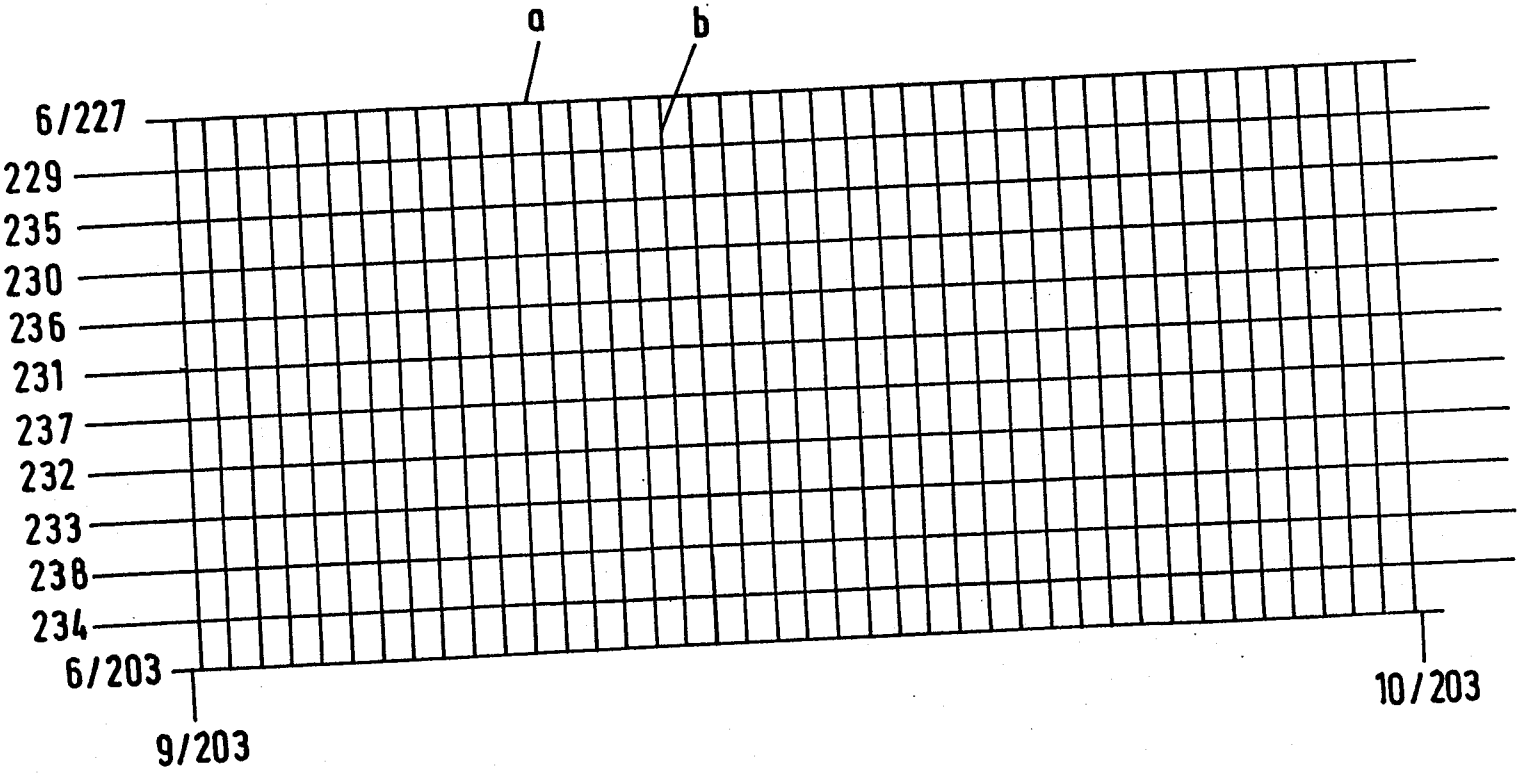
FIG. 5 shows a two-dimensional model of the supercalender for computation in accordance with the finite element method.
Figure 6:
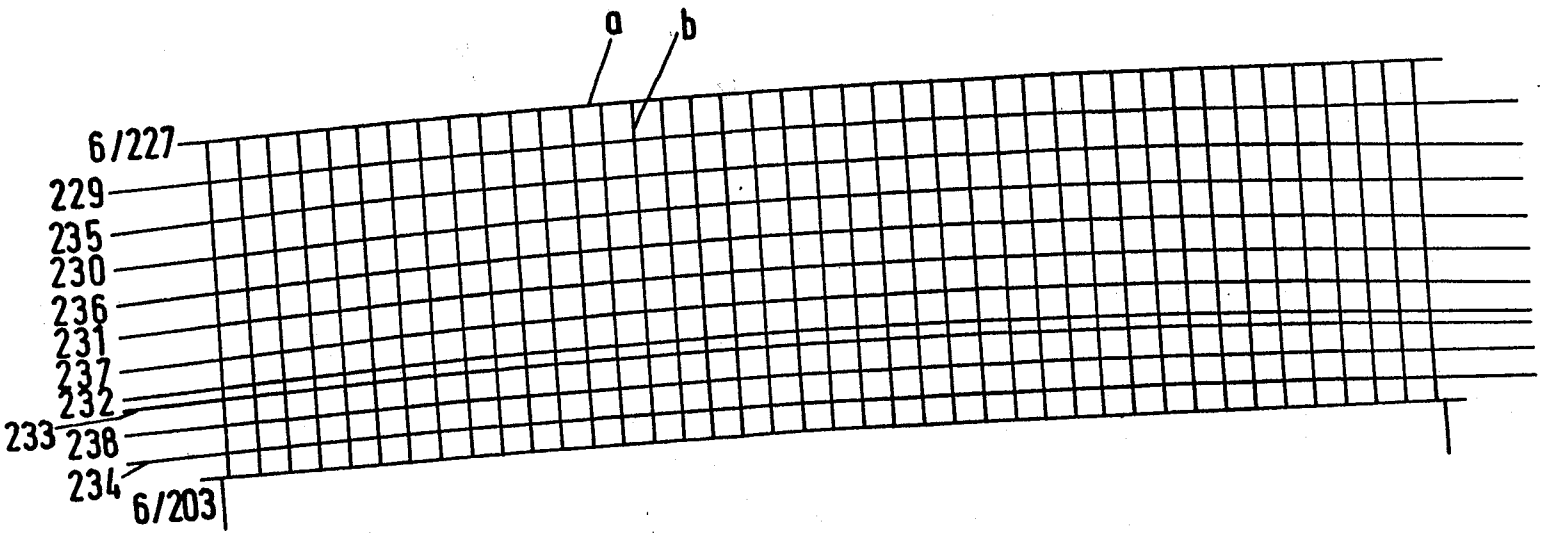
FIG. 6 shows the model of FIG. 5 after a change of the load parameter in a zone of the nip of two rolls in the supercalender of FIG. 4.

The pressure reaction matrix can be established in the following way: As shown in FIGS. 5 and 6 for the supercalender 201, the establishment of a pressure reaction matrix (hereinafter matrix for short) involves the making of a finite element model of the calender. The finite element method is a numeric computation technique according to which complex problems are broken down into small individual or discrete problems (called elements) which are susceptible or more readily of a solution. Depending on the desired degree of accuracy of the computation, a system of rolls can be broken down into three-dimensional or two-dimensional elements. A three-dimensional description is a more accurate replica of the actual structure but involves a more complex computation. FIGS. 5 and 6 illustrate a two-dimensional computation model for the supercalender of FIG. 4.

The horizontal lines a which are shown in FIGS. 5 and 6 denote (starting at the top) the shell 6 of the topmost roll 227 of the supercalender 201, the coated roll 229, the hardened roll 235, the coated roll 230, the hardened roll 236, the coated roll 231, the hardened roll 237, the coated roll 232, the coated roll 233, the hardened roll 238, the coated roll 234 and the shell 6 of the lowermost roll 203. The shell 6 of the lowermost roll 203 is supported by the antifriction bearings 9, 10 at the locations indicated in FIGS. 5 and 6 by short vertical lines. It will be seen that the lines a denote the rolls (229–238) or the shells (6) of the rolls (203, 227). The vertical connecting lines b denote contact elements which imitate the elastic behavior of the coats of rolls (229–234) in the case of a calender or the elastic behavior of the material of the web in the case of glazing machines. The influence of bearing elements 7 and 8, as well as the influence of the cylinder and piston units 14, 15, is indicated by forces at the corresponding points or loci of application. The subdivision into a number of individual fields is carried out in such a way that at least one finite element is available for each zone so that it is possible to ensure an exact application of load to each of the zones. The computation involves the rigidity (stiffness) and the weight of each of the rolls; in addition, the computation takes or can take into consideration the outer diameter, the inner diameter, the modulus of elasticity, the Poisson ratio and the density of each roll. Moreover, it is desirable to take into consideration (for the contact elements b) the compressibility of elastic coatings for the rolls 229–234 in dependency on the material and on the ratio of diameters of neighboring rolls. The projecting or overhanging weights which are attributable to the presence of bearings, guiding rollers, guards and analogous parts are taken into consideration as forces acting upon the bearings for the rolls.

When the two-dimensional model of FIG. 5 is under load, it undergoes deformation in a manner as shown (greatly exaggerated for the sake of clarity) in FIG. 6. It will be noted that the compression or contact elements b in particular undergo pronounced shortening. Substantial compression takes place in the nip of the neighboring coated rolls 232 and 233.

In the first step, one computes the pressures for the actuators A with a view to achieve a constant basic line load in the lowermost nip. This can be carried out for different load levels. The thus obtained field of characteristic curves can be used to select identical line loads in the calender.

In order to be in a position to regulate the calender from zone to zone, it is necessary to ascertain the manner in which the calender reacts in response to changes which take place in a single zone. To this end, one proceeds from a constant reference value of the load parameter by altering the pressure at each of the actuators A by a given value. The change of the load parameter is then ascertained at certain reference points, such as at the centers of the zones $Z_1$ to $Z_6$ and at the edges or ends of the zones $Z_L$ and $Z_R$. The thus ascertained changes are employed to form a matrix which is the aforementioned pressure reaction matrix $R_{ij}$ of the supercalender 201. Reference should be had to the equation (1) in the attached Appendix. In this equation, $\Delta p$ denotes pressure changes, $\Delta q$ denotes changes of the load parameter, and the numerals 1, 2, . . . i, j . . . n denote the zone numbers, i.e., the numbers of the actuators A. Each horizontal line of the equation (1) denotes a zone, and each vertical column of the equation (1) denotes an actuator A.

In the supercalender 201 of FIG. 4, as well as in the compact calender 101 of FIG. 3, wherein two rolls with deformable shells (such as the rolls 203, 227 in FIG. 4 and the rolls 103, 227 in FIG. 3) act in opposite directions, the number of horizontal lines and vertical columns in the pressure reaction matrix $R_{ij}$ is twice the number of zones because any pressure change in an actuator A of one of the rolls 203, 227 or 103, 127 not only exerts an influence in other zones of the respective roll with a deformable shell but also in all zones of the other roll with a deformable shell. For example, if the pressure is altered in one actuator A of the upper roll 127 or 227, this also entails a change of line load in the nip of the rolls 103, 102 or 203, 234.

If the hydraulic cylinder and piston units also play a role, the matrix $R_{ij}^{LR}(Tm)$ is designed to take into consideration the marginal zones in addition to other zones (reference may be had to the equation (2) in the attached Appendix).

As mentioned above, it is possible to establish different matrices for different load conditions. Thus, and as shown in the equation (2), it is possible to establish different matrices for different average values of the temperature in the region of the nip. In addition, it is necessary to carry out changes (i.e., to modify the matrices) if the calender or the glazing machine is modified or altered in other ways, for example, by treating (such as milling) the rolls with attendant reduction of their diameter or by changing the aforediscussed overhanging weights.

The control signals are computed as follows: Let it be assumed that the actual value of the load parameter in the individual zones matches the predetermined reference value $q_{soll}$ in response to the application of corresponding working pressures $p_{io}$, $p_{jo}$. There is then transmitted a command to change the reference value in a zone i by a value $\Delta q_i$. This change of reference value corresponds to a pressure change $\Delta p_i$ in the corresponding actuator A in accordance with the equation (3) in the attached Appendix. The serial number is n. An adjustment in the zone i entails deviations in the zones j, k, etc. as indicated by the equations (4). It is now possible to calculate a fresh actual value of the load parameter in accordance with the equations (5). In the zone wherein the actual value departs from the reference value to a maximum extent, the difference is eliminated mathematically in response to a further pressure change. Such stepwise calculation is repeated as often as necessary to ensure that the error function $F^n$ (refer to the equation (6) in the Appendix) is less than a preselected tolerance value.

The pressures $p_i$, $p_j$ for individual actuators A which are transmitted to the machine as a control signal $p_{soll}$ are calculated in accordance with the equations (7) on the basis of the original working pressure and the sum of all pressure changes which are calculated in the course of the aforementioned iterative routine. The error function $F^n$ corresponds to the square root of the sum of second powers of errors of load parameters in the individual zones.

The iterative approximation routine can be applied also when the machine is to be put to use. The actual value of the load parameter in the columns of the matrix is then selected to equal the basic line load. The computer 16 ascertains the zone of maximum departure of actual value from the reference value (desired value). This zone is fully levelled or balanced in a step which is followed by programmed operation in a manner as outlined above.

It is often desirable to avoid a complete compensation for the difference between the reference value and the actual value (e.g., to bring about an 80-percent compensation) if this leads to a more rapid reduction of the difference to less than the acceptable tolerance value.

As already explained above in connection with FIG. 1, the computer 16 can receive reference values q from the converter 25 so that the aforedescribed procedure is controlled by the characteristics of the running web W or is even tied up or fixed in an overriding or superimposed control circuit.

The computer 16 can automatically select that pressure reaction matrix which is proper for a particular computation. This is due to the fact that the reference value profile can be relied upon to ascertain that average load which is closest to one of the matrices. Analogously, the temperature sensing or monitoring device 24 can be relied upon to facilitate the selection of that reaction matrix which is appropriate for the monitored average temperature.

The diameter of a roll changes in response to temperature changes. Furthermore, and if the roll has a coating of thermoplastic material, the hardness of the peripheral surface (i.e., its modulus of elasticity) changes in response to cooling or heating. This can entail a change of the distribution of line load. A different reaction matrix can be selected to compensate for changes of the entire temperature level. However, temperature changes in the longitudinal direction of the roll can result in undesirable changes of the load parameter. For example, if the line load rises in a particular zone above the line load in other zones, the coat of the roll is heated in the particular zone as a result of increased fulling capacity which, in turn, entails an increase of the diameter in the particular zone. This brings about an increase of the line load so that the roll reaches a stage when the desired reference value of the load parameter can no longer be maintained or adhered to. This can be avoided by causing the controls to take into consideration the monitored temperature so that the controls can bring about a change which ensures that the desired reference value is adhered to in spite of a heating of the coat on the roll.

For this purpose, one establishes temperature-reaction matrices $D_{ij}(Tm)$ for a series of different average temperatures by considering the change $\Delta q$ of the load parameter in a given zone for different temperature changes $\Delta T_1$, $\Delta T_2$ . . . as shown in the equation (8) of the Appendix. The numbering of parameter changes and of temperature changes in the equation (8) corresponds to the numbering of zones.

The mode of regulation with matrices $D_{ij}(T_m)$ as per equation (8) is as follows: The temperature measurements are utilized to ascertain the average value which represents the corresponding temperature level. The average roll temperature is used to ascertain temperature deviations in each of the zones in a manner as shown in the equation (9). Once the temperature differences are ascertained, the results which are obtained thereby can be utilized with the matrix of the equation (8) to compute the changes of parameters in the nip by resorting to the equation (10). Thus, the actual value of the load parameter in each zone is determined on the basis of the momentarily selected pressure in the actuators A and on the basis of the temperature distribution as indicated by the equation (11). This temperature-dependent fraction of the load parameter is to be taken into consideration during comparision of the actual value with the reference value of the load parameter, for example, in a manner as indicated by the equations (12) and (13). The thus obtained reference value is then utilized to compute the pressure adjustment by resorting to the aforediscussed internal iterative routine.

For example, the computer 16 can be of the type known as IBM 7535 (sold by IBM) or of the type known as DEC 11/53 (sold by Digital Equipment Corporation). The memory 22 is or can be a conventional memory with 500 kB. The regulating unit 19 can be of the type known as S 5-150 U (sold by Siemens) or of the type known as A 500 (sold by AEG).

APPENDIX $$R_{ij} = \begin{bmatrix} \frac{\Delta q_1}{\Delta p_1} & \frac{\Delta q_1}{\Delta p_2} & \frac{\Delta q_1}{\Delta p_3} & \cdots & \cdots & \frac{\Delta q_1}{\Delta p_n} \\ \frac{\Delta q_2}{\Delta p_1} & \frac{\Delta q_2}{\Delta p_2} & \frac{\Delta q_2}{\Delta p_3} & \cdots & \cdots & \frac{\Delta q_2}{\Delta p_n} \\ \cdots & \cdots & \cdots & \frac{\Delta q_i}{\Delta p_j} & \cdots & \frac{\Delta q_i}{\Delta p_n} \\ \frac{\Delta q_n}{\Delta p_1} & \frac{\Delta q_n}{\Delta p_2} & \cdots & \frac{\Delta q_n}{\Delta p_j} & \cdots & \frac{\Delta q_n}{\Delta p_n} \end{bmatrix} \quad (1)$$

$$R_{ij}^{LR}(T_m) = \quad (2)$$

$$\begin{bmatrix} \frac{\Delta q_L}{\Delta p_L} & \frac{\Delta q_L}{\Delta p_1} & \frac{\Delta q_L}{\Delta p_2} & \cdots & \cdots & \frac{\Delta q_L}{\Delta p_n} & \frac{\Delta q_L}{\Delta p_R} \\ \frac{\Delta q_1}{\Delta p_L} & \frac{\Delta q_1}{\Delta p_1} & \frac{\Delta q_1}{\Delta p_2} & \cdots & \cdots & \frac{\Delta q_1}{\Delta p_n} & \frac{\Delta q_1}{\Delta p_R} \\ \cdots & \cdots & \cdots & \cdots & \frac{\Delta q_i}{\Delta p_j} & \cdots & \cdots \\ \frac{\Delta q_n}{\Delta p_L} & \frac{\Delta q_n}{\Delta p_1} & \frac{\Delta q_n}{\Delta p_2} & \cdots & \cdots & \frac{\Delta q_n}{\Delta p_n} & \frac{\Delta q_n}{\Delta p_R} \\ \frac{\Delta q_R}{\Delta p_L} & \frac{\Delta q_R}{\Delta p_1} & \frac{\Delta q_R}{\Delta p_2} & \cdots & \cdots & \frac{\Delta q_R}{\Delta p_n} & \frac{\Delta q_R}{\Delta p_R} \end{bmatrix}$$

$$\Delta p_i^n = \frac{1}{\left[\frac{\Delta q_i}{\Delta p_i}\right]} (q_{isoll} - q_{iist}^n) \quad (3)$$

$$\Delta q_j^n = \left[\frac{\Delta q_j}{\Delta p_i}\right] \Delta p_i^n \quad (4)$$

$$\Delta q_k^n = \left[\frac{\Delta q_k}{\Delta p_i}\right] \Delta p_i^n$$

$$q_{iist}^n = q_{iist}^{n-1} + \Delta q_i^n \quad (5)$$

$$q_{jist}^n = q_{jist}^{n-1} + \Delta q_j^n$$

$$F^n = \quad (6)$$

$$\sqrt{(q_{1ist}^n - q_{1soll})^2 + (q_{2ist}^n - q_{2soll})^2 + \ldots + (q_{nist}^n + q_{nsoll})^2}$$

$$p_i = p_{io} + \sum_{m=1}^{n} \Delta p_i^m \quad (7)$$

$$p_j = p_{jo} + \sum_{m=1}^{n} \Delta p_j^m$$

-continued

APPENDIX $$D_{ij}(T_m) = \begin{bmatrix} \frac{\Delta q_1}{\Delta T_1} & \frac{\Delta q_1}{\Delta T_2} & \frac{\Delta q_1}{\Delta T_3} & \cdots & \cdots & \frac{\Delta q_1}{\Delta T_n} \\ \frac{\Delta q_2}{\Delta T_1} & \frac{\Delta q_2}{\Delta T_2} & \frac{\Delta q_2}{\Delta T_3} & \cdots & \cdots & \frac{\Delta q_2}{\Delta T_n} \\ \cdots & \cdots & \cdots & \frac{\Delta q_i}{\Delta T_j} & \cdots & \cdots \\ \frac{\Delta q_n}{\Delta T_1} & \frac{\Delta q_n}{\Delta T_2} & \frac{\Delta q_n}{\Delta T_3} & \cdots & \cdots & \frac{\Delta q_n}{\Delta T_n} \end{bmatrix} \quad (8)$$

$$\Delta T_i = T_i - T_m \; (i = 1,2 \ldots, n) \quad (9)$$

$$\Delta q_{iist}(\Delta T) = D_{ij}(T_m) \cdot \Delta T_j \; (i,j = 1,2, \ldots, n) \quad (10)$$

$$q_{iist} = q_{iist}(p) + \Delta q_{iist}(\Delta T) \quad (11)$$

$$\Delta q_{isoll}(p) = q_{iist} - q_{isoll} \quad (12)$$

$$q_{isoll}(p) = q_{isoll} - \Delta q_{isoll}(p) \quad (13)$$

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of regulating the operation of a calender or an analogous machine with at least two neighboring rolls which define an elongated nip and the load parameters, such as the line load or the compressive strain, in a plurality of different longitudinally spaced apart zones of the nip are controlled by discrete actuators which receive a fluid medium at a variable pressure so that they can alter the parameters in the corresponding zones of the nip, and wherein a change to bring about a deviation of the parameter in one of the zones from a reference value tends to entail changes of parameters in other zones of the nip, comprising the steps of establishing at least one pressure reaction matrix with elements which denote those deviations of actual values of parameters for said other zones from reference values which take place in response to a change of parameter in the one zone; utilizing said matrix to individually calculate seriatim for the actuator for each of said other zones that pressure variation which at least partially compensates for departure of actual value of the parameter in the respective zone from the reference value and to further calculate the resulting change of parameter for each other zone until an error function which is dependent upon the differences between the actual values of parameters and the reference values is within a predetermined range of tolerances; and varying the pressure of fluid for the actuators in accordance with the sum of variations which are calculated for the respective actuators.

2. The method of claim 1, wherein the step of establishing the matrix includes individually ascertaining for each of said zones the extent of alteration of parameter in one of said zones in response to a predetermined variation of fluid pressure for the respective actuator while the fluid pressure for all other actuators remains unchanged, and forming quotients of parameter alterations and pressure variations, such quotients constituting the elements of the matrix.

3. The method of claim 2, wherein the matrix has lines pertaining to said zones and columns pertaining to said actuators.

4. The method of claim 1, wherein the step of establishing the matrix includes introducing pressure-responsive materials into the zones of the nip, measuring the extent of response to introduced materials to pressure, and generating signals denoting the results of the measurements and constituting the elements of the matrix.

5. The method of claim 1, wherein the step of establishing the matrix includes forming a mathematical model of the machine and utilizing the model for computation of said elements.

6. The method of claim 5, wherein said computation is carried out in accordance with the finite element process.

7. The method of claim 1, wherein said step of establishing the matrix includes setting up a load parameter which is constant in all zones of the nip, and changing such constant parameter from zone to zone for the purpose of ascertaining the elements of the matrix.

8. The method of claim 1, wherein said pressure varying step includes (a) ascertaining the zone with maximum difference between the actual value and the reference value of the parameter and utilizing the respective element of the matrix for calculation of a pressure variation which corresponds to the maximum difference, (b) utilizing the thus calculated pressure variation and the elements in the corresponding line of the matrix for the calculation of parameter alteration in other zones of the nip, (c) forming for the parameter of each zone a new actual value by totalizing the previous actual value and the respective alteration, (d) calculating for a zone other than said ascertained zone—and with the corresponding element of the matrix—a pressure variation which effects a parameter alteration corresponding to the difference between the new actual value and the reference value, (e) utilizing said pressure variation and the elements in the same line of the matrix for calculation of parameter alterations in other zones of the nip, (f) forming for each zone a new actual value of the respective parameter from the sum of the previous actual value and the alteration of the respective parameter, (g) repeating the steps (d) and (e) and (f) for other zones until said error function is within said range, and (h) and varying the fluid pressure for the actuators so that the fluid pressure equals the sum of the theretofore prevailing pressure and all corresponding pressure variations.

9. The method of claim 1, wherein said establishing step comprises setting up a plurality of two-dimensional matrices for different operating conditions of the machine, said utilizing step comprising employing that one of said plurality of matrices which is compatible with the operating condition of the machine.

10. The method of claim 9, wherein said establishing step comprises setting up discrete matrices for at least two different ranges of reference values of the load parameter.

11. The method of claim 9, wherein said establishing step comprises setting up a discrete matrix for at least two different diameters of at least one of the rolls.

12. The method of claim 9, wherein said establishing step comprises setting up a discrete matrix for at least two different average temperatures of the peripheral surface of at least one of the rolls.

13. The method of claim 12, further comprising the steps of measuring the temperatures along the nip, ascertaining the average value of the measured temperatures, and selecting the corresponding matrix for said utilizing step.

14. The method of claim 1, further comprising the steps of ascertaining for each of said zones the extent of parameter alteration in response to a plurality of predetermined temperature changes in the respective zone, and utilizing the thus ascertained parameter alterations as correction factors in the differences between the actual values and the reference values of the respective parameters.

15. The method of claim 1 of regulating the operation of a machine with at least three rolls defining at least two nips and including at least two rolls with bending compensation, wherein said establishing step includes setting up a pressure reaction matrix with elements for all zones of each of said nips.

16. The method of claim 1, wherein one said rolls is a bending compensation roll and the actuators include hydraulic cylinder and piston units for moving the ends of the bending compensation roll.

17. The method of claim 1, wherein said varying step includes varying the pressure of fluid for the actuator which controls the zone with maximum difference between the actual value and the reference value of the respective load parameter.

18. The method of claim 1, wherein said utilizing step is repeated a number of times at least matching the number of zones in the nip.

19. The method of claim 1, wherein said utilizing step is started with, and is repeated at least once for, a particular actuator.

20. The method of claim 1, wherein said error function is the square root of the sum of squares of errors for all of the zones.

21. The method of claim 1, further comprising the steps of advancing a web of flexible material through the nip of said rolls, monitoring the characteristics of the advancing web, and varying the load parameter profile along the nip as a function of changes of monitored characteristics of the web.

22. Apparatus for regulating the operation of a calender or an analogous machine wherein at least two neighboring rolls define an elongated nip and at least one of the rolls is deformable by a plurality of discrete actuators, one for each of a plurality of different zones of the nip, and wherein the actuators are connected with a source of pressurized fluid and the pressure of fluid is variable by signal-responsive regulating devices to thereby alter the load parameters, such as the line load or the compressive strain in the respective zones of the nip, comprising computer means having first input means for signals denoting reference values of the load parameters and second input means; and a memory arranged to store at least one pressure reaction matrix and connected with said second input means, said matrix having elements indicative of those deviations of actual values of parameters for said zones from reference values which take place in response to a change of fluid pressure for one of said actuators, said computer means having signal transmitting output means connected with said regulating devices.

23. The apparatus of claim 22, further comprising regulating means interposed between said devices and said computer means and having means for converting the signals from said computer means into ramp functions so as to prevent abrupt changes of fluid pressure for said actuators.

24. The apparatus of claim 22, further comprising means for monitoring the temperature along said nip and for transmitting corresponding signals to said computer means so that the signals from said monitoring means influence the signals to said devices.

25. The apparatus of claim 22 for regulating the operation of a machine wherein a web is advanced through the nip, further comprising means for monitoring the characteristics of the advancing web and for transmitting to said computer means signals which are indicative of the monitored characteristics so that the signals from said monitoring means influence the signals to said devices.

* * * * *